US007572210B2

(12) United States Patent
Marinello

(10) Patent No.: US 7,572,210 B2
(45) Date of Patent: Aug. 11, 2009

(54) TRAINING AID FOR GRIPPING A BALL

(76) Inventor: Gaspare Frank Marinello, 1745 77th St., Brooklyn, NY (US) 11214

( * ) Notice: Subject to any disclaimer, the term of this patent is extended or adjusted under 35 U.S.C. 154(b) by 0 days.

(21) Appl. No.: 11/431,279

(22) Filed: May 9, 2006

(65) Prior Publication Data

US 2007/0265141 A1 Nov. 15, 2007

(51) Int. Cl.
*A63B 23/16* (2006.01)

(52) U.S. Cl. ..... 482/47; 482/44

(58) Field of Classification Search ..... 482/44, 482/47–49; 40/237; 473/613–615, 595–602, 473/451; D21/713, 204
See application file for complete search history.

(56) References Cited

U.S. PATENT DOCUMENTS

| | | | | | |
|---|---|---|---|---|---|
| 1,217,681 | A | * | 2/1917 | Baldridge | 441/58 |
| 1,868,822 | A | * | 7/1932 | Goldkind | 2/20 |
| 2,925,273 | A | | 2/1960 | Pratt | |
| 4,128,238 | A | | 12/1978 | Newcomb et al. | |
| 4,679,799 | A | * | 7/1987 | Coletti | 473/505 |
| 4,754,499 | A | * | 7/1988 | Pirie | 2/20 |
| 4,828,249 | A | * | 5/1989 | Keating | 482/48 |
| 4,977,621 | A | * | 12/1990 | Richard | 2/161.3 |
| 4,991,838 | A | | 2/1991 | Groves | |
| 5,013,030 | A | * | 5/1991 | Frins | 482/47 |
| 5,366,436 | A | * | 11/1994 | Gibney | 601/40 |
| D362,018 | S | * | 9/1995 | Damm | D19/36 |
| 5,472,187 | A | | 12/1995 | Kempf | |
| 5,603,679 | A | * | 2/1997 | Reis | 482/106 |
| D381,129 | S | * | 7/1997 | Lawrence | D29/115 |
| 5,770,297 | A | * | 6/1998 | Grubich | 428/99 |
| 5,984,813 | A | | 11/1999 | Cinnella | |
| 6,228,001 | B1 | * | 5/2001 | Johnson et al. | 482/48 |
| 6,454,681 | B1 | * | 9/2002 | Brassil et al. | 482/49 |
| D465,617 | S | * | 11/2002 | DeLaup | D29/113 |
| 6,511,403 | B2 | * | 1/2003 | Hsieh | 482/45 |
| 6,745,907 | B2 | * | 6/2004 | Kjelgaard | 211/69.5 |
| 6,898,802 | B1 | * | 5/2005 | Suarkeo | 2/20 |
| 2003/0119632 | A1 | * | 6/2003 | Archuleta | 482/49 |
| 2004/0016710 | A1 | * | 1/2004 | Kjelgaard | 211/69.5 |
| 2006/0079380 | A1 | * | 4/2006 | Wells | 482/49 |
| 2006/0283719 | A1 | * | 12/2006 | Surabischwili | 206/1.7 |

* cited by examiner

*Primary Examiner*—Lori Amerson
(74) *Attorney, Agent, or Firm*—Kenyon & Kenyon LLP

(57) ABSTRACT

A device for training an athlete to grip a ball, which is particularly well-suited to train an individual, such as a girl, to correctly grip a softball. The device may include a body having two or more openings defined thereby. Each one of the openings is configured to have inserted therein at least one finger of a user. When worn by a user, the grip training device causes a ball that is held by the user to be spaced apart from the user's palm and to be gripped by the fingertips, which may provide additional control and speed of the ball when pitched. The grip training device may include, e.g., five openings, wherein each one of the five openings is configured to have inserted therein one of the five fingers of a user's hand, or may instead include a multi-finger opening that is configured to have inserted therein more than one finger of a user's hand.

12 Claims, 1 Drawing Sheet

TRAINING AID FOR GRIPPING A BALL

FIELD OF THE INVENTION

The present invention relates to an apparatus for developing a proper grip in athletics, and more particularly to an apparatus that functions as a training aid for gripping a ball, e.g., a softball.

BACKGROUND INFORMATION

There are various sports in which it is desirable that an athlete grip a ball in a particular way in order to optimize the athlete's performance in that particular sport. To this end, there are various known devices that purport to assist or train an athlete to correctly grip and/or throw a ball. For example, some of these known device include:

U.S. Pat. No. 5,472,187 ("Kempf") is related to a ball pitching training device. Kempf describes a disk-shaped device having two flat sides lying in parallel planes substantially one-inch apart and a circular profile with a circular perimeter surface connecting the two circular flat sides. The function of the device is purported to be as training participants to make a proper throwing motion with the pitching arm.

U.S. Pat. No. 4,991,838 ("Groves") is related to a marked baseball cover. Groves describes a conventional baseball cover that has colored, lined markings on the cover that are purported to help either a pitcher or a batter to determine the amount of curve or spin that a thrown ball.

U.S. Pat. No. 5,984,813 ("Cinnella") is related to an instructional baseball. Cinnella purports to describe a baseball for teaching a pitcher the proper way to throw a curveball. The baseball is shown as being generally spherical in shape and having various depressions that provide the ball with an exaggerated trajectory when thrown correctly.

U.S. Pat. No. 2,925,273 ("Pratt") is related to a baseball training aid. Pratt purports to describe that a baseball includes various indicia located on the surface of the ball for providing an indication to a pitcher of where to place his fingers.

U.S. Pat. No. 4,128,238 ("Newcomb et al.") is related to a practice baseball. Newcomb et al. purport to describe a baseball that is made to meet playing rule requirements as to size and weight but which has a small segment removed therefrom. Newcomb et al. contend that the ball, when thrown by a pitcher without any twist being imparted to the ball, will curve in the same manner and degree as a conventional baseball when thrown by a competent curve ball pitcher.

An example of a sport in which the athlete's grip may contribute to the performance of the athlete is softball. However, none of these prior art references adequately provide a device for developing a proper grip in athletics, and more particularly to a device that functions as a training aid for gripping a ball, e.g., a softball.

SUMMARY OF THE INVENTION

The present invention relates to a device for training an athlete to grip a ball, which is particularly well-suited to train an individual, such as a girl, to correctly grip a softball. The device may include a body and two or more openings defined by the body. Each one of the openings is configured to have inserted therein at least one finger of a user. When worn by a user, the grip training device causes a ball that is held by the user to be spaced apart from the user's palm and to be gripped by the fingertips, which may provide additional control and speed of the ball when pitched. The grip training device may include, e.g., five openings, wherein each one of the five openings is configured to have inserted therein one of the five fingers of a user's hand. Alternatively, the grip training device may instead include a multi-finger opening that is configured to have inserted therein more than one finger of a user's hand, e.g., two or more of the three middle fingers of a user's hand.

The openings may have a generally circular shape or any other suitable shape. Also, the openings may be about the same size relative to each other, or else may be different in size relative to each other, such as when a first opening is larger in size than a second opening in accordance with the relative size of the fingers that are to be inserted into the respective openings. In addition, the openings may be equally spaced apart from each other, or else may be unequally spaced apart from each other, such as when the openings are spaced apart from each other in accordance with a natural spacing of a user's fingers relative to each other or when the openings are spaced apart from each other in accordance with a desired position of each finger. In an embodiment, the openings are spaced apart such that, when used to grip a softball, the openings position the pinky and thumb of a user's hand at opposite locations on a softball's circumference.

In an embodiment, the body of the grip training device may have a generally flat and symmetrical profile, which may enable the grip training device to be worn on either one of the user's hands. Alternatively, the body of the grip training device may have a contoured profile, such that the grip training device is configured to be worn on a specific one of the user's hands. In this case, the grip training device may be marked so as to provide an indication to a user which one of the user's hands the device is configured to be worn on. Also, the grip training device may be configured such that a single size of the device may fit any hand, or else the grip training device may be one of a set of devices, each one of the set of devices being of a different size so as to accommodate different size hands.

Additional features of the grip training device of the present invention are discussed in greater detail below.

DETAILED DESCRIPTION

Figure 1:
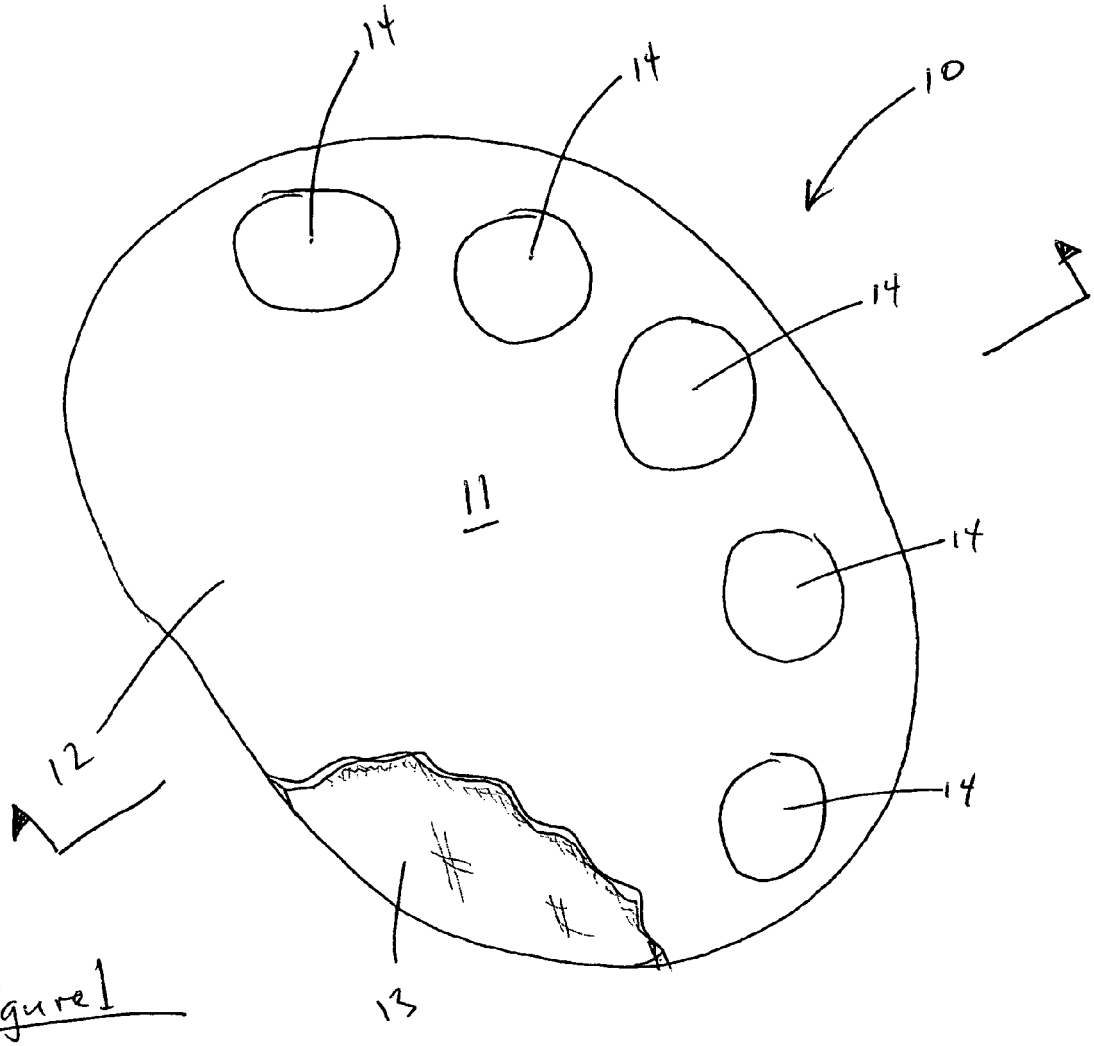
FIG. 1 is a top view of a grip training device, according to one embodiment of the present invention.

The present invention, according to one embodiment thereof, is directed to a training aid for gripping a ball.

As set forth above, there are various sports in which an athlete may grip a ball in a particular way in order to optimize the athlete's performance in that particular sport. For example, it may be advantageous, from the standpoint of an athlete's performance in a particular sport, for an athlete to grip a ball with his or her fingertips, rather than to grip a ball with his or her palm.

One such sport is softball. For the sake of example only, the present invention will be described herein in connection with a training aid for a softball pitcher to assume the proper grip of the softball when pitching the softball. It should be understood, however, that the present invention may be employed as a training aid for assisting athletes in different sports, e.g., basketball, baseball, football, bowling, etc. In these sports, there may be particular instances where it is advantageous for an athlete to grip a ball in a particular way, e.g., by the athlete's finger tips and away from the athlete's palm. Thus, the present invention may find applicability in the training regimen of any sport in which such a grip may be used to advantage.

It should also be understood that, while some embodiments of the present invention are described herein as a training aid for an athlete to grip a ball, other embodiments may be employed by an athlete during an actual sports competition. In other words, in some embodiments, the grip training device 10 may be employed as an aid which is used in practice sessions so as to assist or teach the athlete to use a similar grip of the ball during a competition, e.g., when it may not be permissible or advantageous to wear the grip training device 10. However, in other embodiments, the grip training device 10 may be employed by an athlete during an actual sports competition, e.g., in those competitions in which it is permissible and/or advantageous to wear the grip training device 10.

The specific example embodiment of a grip training device 10 used as a training aid for a softball pitcher to assume the proper grip of the softball when pitching the softball shall now be described. In order for an athlete to optimally pitch a softball, the athlete typically needs to grip the softball in a particular way, e.g., with his or her fingertips. Generally, in order for an athlete to best control the softball, e.g., when pitching the softball, the athlete gently grips the ball at opposite sides of its circumference with his or her pinky and thumb. The remaining three fingers then are placed on or adjacent to the seam of the softball. Once the softball is gripped in this way, the softball may be pitched, e.g., underhand, towards the batter. Of course, there are numerous different ways for an athlete to position his or her fingers relative to the ball. However, it is commonly taught that this grip provides the greatest advantages to the athlete in terms of controlling the path and the speed of the softball when thrown.

Depending on the size and or shape of an athlete's hand, a particular grip may not be easily assumed. Referring to the above-described example of a fingertip-type grip on a softball, such a grip may be difficult or unnatural to an athlete having a relatively small hand size. An athlete with a relatively small hand size relative to a softball may have an inclination to grip the softball with the athlete's palm touching the softball, which may negatively affect the athlete's performance in pitching the softball. The present invention, in accordance with various embodiments thereof, may assist an athlete to grip the ball in the optimal manner by forcing the athlete to practice gripping the ball so as to be spaced away from the palm and to be placed at the fingertips.

FIG. 1 is a top view of a grip training device 10, according to one embodiment of the present invention. The grip training device 10 includes a body 11. The body 11 may include a shell 12 that covers an inner core 13. The shell 12 may be comprised of any material, e.g., plastic, vinyl, leather, denim, cotton, etc., but preferably is comprised of a material that may be easily cleaned and/or that does not absorb undue quantities of liquid, e.g., sweat from the athlete's hand. The inner core 13 may be comprised of any flexible or semi-rigid material, e.g., sponge padding, pellets, etc., that may conform to an athlete's hand while at the same time providing and maintaining adequate spacing of a ball from the palm of the athlete's hand and adequate spacing of the athlete's fingers relative to each other. Alternatively, the body 11 of the grip training device 10 may be composed of a single material, rather than having a separate shell 12 and inner core 13.

FIG. 1 illustrates the grip training device 10 having, when viewed in this top position, a generally oval or kidney-bean-type shape. It should be understood, however, that a variety of shapes may be employed. For example, the grip training device 10 may have, when viewed in this top position, a square shape, a circular shape, or any other suitable shape.

FIG. 1 illustrates the grip training device 10 having, when viewed in this top position, five openings 14. Each one of these five openings 14 is configured to have inserted therein a finger of the athlete. In FIG. 1, each one of these openings 14 is illustrated as having a generally circular shape. It should be understood, however, that a variety of shapes of the openings 14 may be employed. For example, the openings 14 may have, when viewed in this top position, an oval shape, a square shape, or any other shape that is suitable for receiving therein a finger of an athlete. Also, in FIG. 1, each one of these openings 14 is illustrated as being roughly the same size relative to each other. It should be understood, however, that the openings may be different sizes relative to each other. For example, the first opening 14 may be larger in size than a second opening in accordance with the relative size of the fingers that are to be inserted into the respective openings. For example, an opening 14 that is configured to have inserted therein an athlete's thumb may be sized larger than an opening that is configured to have inserted therein an athlete's pinky. In this manner, a more comfortable fit may be realized by the athlete, with a reduced likelihood that the grip training device 10 will undesirably move or fall off of the athlete's hand during use.

Also, the grip training device 10 in FIG. 1 is shown as having five openings 14, wherein each one of the five openings 14 is configured to receive one of the five fingers of the athlete. It should be understood, however, that the grip training device 10 may instead have more or less than five openings 14. For example, in an embodiment, one or more of the openings 14 shown in FIG. 1 may be combined into a single, larger opening that is sized and configured to receive more than one of the athlete's fingers. For example, it may be desirable that the middle three openings 14 of the grip training device 10 illustrated in FIG. 1 be replaced with a long oval shaped opening that is configured to have inserted therein two or three of the middle fingers of an athlete's hand, e.g., excluding the thumb and pinky. Such an arrangement may provide greater flexibility of movement for these three middle fingers, while still providing adequate spacing of the five fingers of the athlete's hand.

It should also be understood that, in various embodiments, the grip training device 10 may be configured such that the openings receive fewer than the athlete's five fingers. For example, in an embodiment, one or more of the openings 14 shown in FIG. 1 may be eliminated, such that four or fewer fingers of the athlete are inserted through openings. Such an arrangement may be advantageous when it is desired that only a certain number of the athlete's fingers, e.g., less than five, be restrained by or placed into a particular position by the grip training device 10.

As set forth above, the size of the openings 14 may be configured so as to accommodate different size fingers of a particular athlete's hand. Also, the spacing and orientation of the openings 14 (whatever number of openings 14 there may be) may be configured so as to be equal distance apart relative to each other, or in accordance with the natural spacing of a typical user's fingers relative to each other, in addition to the desired spacing and orientation of the fingers for the given sport. For example, the openings 14 may be spaced and oriented relative to each other with due consideration to the fact that all five fingers of an athlete's hand are not spaced equally apart, e.g., the thumb is further spaced apart from the remaining four fingers, which are spaced relatively close together. Thus, the opening 14 that is configured to receive the thumb may advantageously be spaced further apart from the other openings 14 so as to provide a more comfortable fit. In addition, the spacing and orientation of each opening 14 may also depend on the desired position of each finger to achieve an optimal grip for the ball in question. For example, in order to position the pinky and thumb of a pitcher's hand at opposite locations on a softball's circumference, the openings 14 that are configured to receive the thumb and pinky may have a spacing and orientation that is particularly suited to arrange the thumb and pinky of the user at the desired locations when inserted into the corresponding openings 14. In this manner, the grip training device 10 may simultaneously provide a comfortable fit when used by an athlete, while at the same time providing maximum effectiveness as a training aid in positioning the fingers of a user for optimal performance.

Figure 2:
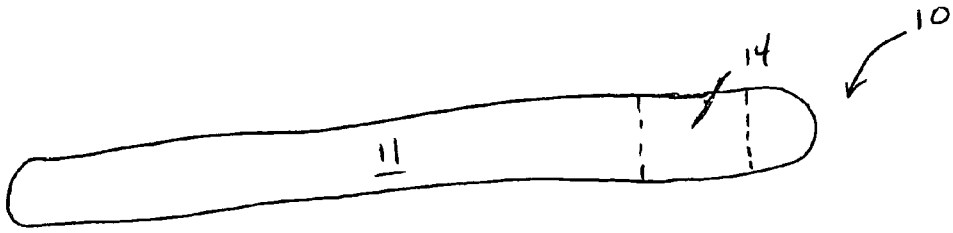
FIG. 2 is a side, cross-sectional view of the grip training device of FIG. 1.

FIG. 1 illustrates the grip training device 10 having, when viewed in this top position, a generally symmetrical arrangement. FIG. 2 is a side view of the grip training device 10, according to one embodiment of the present invention. FIG. 2 illustrates the grip training device 10 having, when viewed in this side position, a generally flat and symmetrical profile. When the grip training device 10 is generally symmetrical in the top view (as shown in FIG. 1) as well as being generally flat and symmetrical in profile (as shown in FIG. 2), the grip training device 10 may be worn on either of the user's hand, e.g., depending on which hand is the user's natural pitching or throwing hand. Also, this arrangement allows the grip training device 10 to be worn with either of its sides facing the palm of the user's hand, irrespective of which of the user's hands is using the grip training device 10. This may simplify the use of the device, in that a user will not inadvertently put the grip training device 10 on his or her hand in an incorrect orientation. Thus, the grip training device 10 may be worn on either of the user's hand, depending on which hand is the user's natural pitching or throwing hand.

It should be understood, however, that in other embodiments of the present invention, the grip training device 10 may have an arrangement that is specific to a particular hand of the user, e.g., the right hand or the left hand. For example, the grip training device 10 may be asymmetrical in the top view, such as by the openings 14 being spaced asymmetrically relative to each other or relative to the body 11, or by the openings being individually sized or oriented to a specific finger of the user, e.g., the thumb. Additionally or alternatively, in other embodiments of the present invention, the grip training device 10 may be contoured so as to have a non-flat profile. Such an arrangement may be advantageous to space a ball at a distance from the palm of the user's hand that is different from a distance that would otherwise be obtained with a grip training device 10 having a flat profile. To prevent the grip training device 10 from being employed on the wrong hand, a grip training device 10 having a first arrangement for a right hand, e.g., for users whose natural pitching or throwing hand is the right hand, may be marked "RIGHT" or with some other designation, while a grip training device 10 having a second arrangement for a left hand, e.g., for users whose natural pitching or throwing hand is the left hand, may be marked "LEFT" or with some other designation.

It should also be understood that the grip training device 10 may, in an embodiment of the present invention, be configured such that a single size of the grip training device 10 fits any hand that uses it. Alternatively, the grip training device 10 may be provided as one of a set of devices, each one of the set having a different size so as to accommodate different size hands. In this way, the fingers of a user having, e.g., a small hand, would not be forced by a grip training device 10 that is too large into a position which places that user's fingers in a position on the ball which is not optimal to that user's performance.

The grip training device 10 of the present invention, in accordance with various embodiments described hereinabove, may be used in many different ways. Again, for the purposes of example only, the use of the present invention will be described hereinbelow in connection with a training aid for a softball pitcher to assume the proper grip of the softball when pitching the softball, although it should be understood that the present invention may be employed as a training aid for assisting athletes in different sports, e.g., basketball, baseball, football, bowling, etc., or may be employed by an athlete during an actual sports competition to insure a desired grip of a ball. When used as a training aid for a softball pitcher to assume the proper grip of the softball when pitching the softball, a user may insert his or her fingers through those openings 14 of the grip training device 10 that are configured to receive the fingers. When worn in this manner, the grip training device 10 is positioned over the palm of the user's hand. Advantageously, the outermost openings 14, e.g., the openings that are located on opposite sides of the grip training device 10, are spaced apart such that they position the pinky and thumb of a user's hand at opposite locations on a softball's circumference when the softball is gripped. Simultaneously, the body 11 of the grip training device 10, by virtue of its positioning over the palm of the user's hand, prevents the ball from contacting the palm of the user's hand and spaces it away from the palm. This way, an optimal grip of the softball, from the standpoint of performance, e.g., control and speed of the softball when pitched, may be obtained. Repeated use of the grip training device 10 during training may encourage an athlete to use a similar optimal grip during an actual game, even when the grip training device 10 is not being worn.

As set forth above, the present invention, in those embodiments in which the grip training device 10 is employed as a training aid for pitching a softball, may be particularly well-suited for individuals that have relatively small hands, e.g., such as women, children, girls, etc., since small hands may contribute to the tendency of an athlete to grip a softball having his or her palm in contact with the ball. It should be understood, however, that the present invention may be employed by individuals having hands of any size.

Thus, the several aforementioned objects and advantages of the present invention are most effectively attained. Those skilled in the art will appreciate that numerous modifications of the exemplary embodiment described hereinabove may be made without departing from the spirit and scope of the invention. Although various exemplary embodiments of the present invention has been described and disclosed in detail herein, it should be understood that this invention is in no sense limited thereby.

What is claimed is:

1. A method for using a grip training device in combination with a ball comprising the steps of:

inserting fingers of a hand through openings in the grip training device, the grip training device having opposing first and second surfaces, each of the openings extending from the first surface to the second surface, the fingers passing through the openings in the first surface and extending out of the grip training device past the second surface, the grip training device configured to maintain a predetermined spacing between each of the fingers;

gripping the ball using at least a portion of the fingers such that the grip training device lies between the ball and a palm of the hand; and releasing and imparting momentum to the ball away from the grip training device while the fingers are both positioned and constrained in movement by the grip training device and without changing the predetermined spacing maintained between the fingers by the grip training device.

2. The method of claim 1, further comprising the steps of removing the grip training device after the releasing and imparting momentum step, gripping the ball without the grip training device, in the same position the ball was gripped while using the grip training device, and then using the ball in a game.

3. The method of claim 1, wherein one of the openings is configured to have inserted therein two or more of the three middle fingers of a user's hand.

4. The method of claim 1, wherein at least two of the openings have different sizes.

5. The method of claim 1, wherein the openings are spaced apart from each other in accordance with a natural spacing of a user's fingers.

6. The method of claim 1, wherein the inserting involves inserting the user's pinky and thumb and the openings are spaced such that the user's pinky and thumb are positioned to grip opposite sides of the ball, and wherein the gripping is accomplished using the user's pinky and thumb on opposite sides of the ball.

7. The method of claim 6, further comprising placing three fingers other than the pinky and thumb through the openings and gripping the ball with these fingers one of on and adjacent a seam of the ball.

8. The method of claim 1, wherein the grip training device has a generally flat and symmetrical side profile.

9. The method of claim 1, wherein the grip training device has a contoured side profile.

10. The method of claim 1, wherein the device is one of a set of devices, each one of the set of devices being of a different size so as to accommodate different size hands.

11. The method of claim 1, wherein the device includes a body having a shell and a core inside the shell made from a different material than the shell.

12. The method of claim 1, wherein the inserting involves placing two or more fingers through one hole and a single finger through another hole.

* * * * *